US007484640B2

(12) United States Patent
von Falkenhausen et al.

(10) Patent No.: US 7,484,640 B2
(45) Date of Patent: Feb. 3, 2009

(54) DISPENSING DEVICE FOR FLAT DOSAGE FORMS

(75) Inventors: Christian von Falkenhausen, Meckenheim (DE); Markus Krumme, Randolph, NJ (US); Christian Gutsche, Meckenheim (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 279 days.

(21) Appl. No.: 10/497,585

(22) PCT Filed: Nov. 16, 2002

(86) PCT No.: PCT/EP02/12874

§ 371 (c)(1),
(2), (4) Date: Jun. 3, 2004

(87) PCT Pub. No.: WO03/048003

PCT Pub. Date: Jun. 12, 2003

(65) Prior Publication Data

US 2005/0017018 A1 Jan. 27, 2005

(30) Foreign Application Priority Data

Dec. 5, 2001 (DE) ..... 101 59 746

(51) Int. Cl.
*B65H 1/08* (2006.01)
*G07F 11/16* (2006.01)

(52) U.S. Cl. ..... 221/231; 221/250; 221/73; 221/249; 206/38; 206/39.4; 206/63.2

(58) Field of Classification Search ..... 221/250, 221/25, 73, 30, 259, 269, 246, 210, 232, 221/249, 262, 270, 274, 65, 231; 206/38, 206/39.4; 83/946, 401, 422, 425, 435, 431, 83/436.3, 648, 856; 225/53, 39; 156/344
See application file for complete search history.

(56) References Cited

U.S. PATENT DOCUMENTS 599,821 A * 3/1898 Adkins ..... 221/231

(Continued)

FOREIGN PATENT DOCUMENTS

CA 2 351 853 A1 6/2000

(Continued)

*Primary Examiner*—Gene Crawford
*Assistant Examiner*—Rakesh Kumar
(74) *Attorney, Agent, or Firm*—Frommer Lawrence & Haug LLP

(57) ABSTRACT

The invention relates to a device for storing and providing stacked film pockets (10) filled with film-type or laminar materials (1). Said materials, e.g. lamellae (1), are individually packed in thin film pockets (10) which are embodied in the form of primary packaging. Said film pockets (10) are stacked in a form of so-called secondary packaging (30) in a gauged manner, the secondary packaging (30) being a lamella dispenser. Said dispenser is provided with a mechanism (61) by which means the individual film pockets (10) are directly released. During said process, the film pockets (10) are automatically opened and the individual lamellae (1) are administered for consumption. The present invention enables a device to be created for storing and providing stacked film-type or laminar materials (1), said device storing said stacked materials (1) from the first to the last withdrawal without any significant change in the aromatic properties of the materials.

20 Claims, 4 Drawing Sheets

U.S. PATENT DOCUMENTS

| | | | | | |
|---|---|---|---|---|---|
| 1,276,493 | A | * | 8/1918 | Cooke | 221/231 |
| 2,969,144 | A | * | 1/1961 | Zackheim | 206/441 |
| 3,780,605 | A | * | 12/1973 | Fingerle et al. | 83/874 |
| 4,304,333 | A | * | 12/1981 | Kozlow, Sr. | 206/441 |
| 4,722,256 | A | * | 2/1988 | Kuehnert | 83/42 |
| 4,993,586 | A | | 2/1991 | Taulbee et al. | |
| 5,306,378 | A | * | 4/1994 | Takimoto et al. | 156/344 |
| 5,337,897 | A | | 8/1994 | Yablans | |
| 5,466,324 | A | * | 11/1995 | Mailloux | 156/344 |
| D371,723 | S | | 7/1996 | Hirao | |
| 5,619,898 | A | * | 4/1997 | Witt | 83/870 |
| 5,827,591 | A | * | 10/1998 | Blok et al. | 428/41.7 |
| 6,155,456 | A | * | 12/2000 | Archer | 221/231 |
| 6,213,343 | B1 | | 4/2001 | Damikolas | |
| 6,962,292 | B1 | * | 11/2005 | Benton et al. | 235/487 |

FOREIGN PATENT DOCUMENTS

| | | | | |
|---|---|---|---|---|
| DE | 3128547 | A1 | | 2/1983 |
| EP | 0325360 | A1 | | 7/1989 |
| JP | 10203722 | A | * | 1/1998 |
| WO | WO 95/18046 | | | 7/1995 |
| WO | WO 99/28211 | | | 6/1999 |
| WO | WO 9928211 | A1 | * | 6/1999 |

* cited by examiner

DISPENSING DEVICE FOR FLAT DOSAGE FORMS

The invention relates to a device for storing and providing stacked film pockets filled with film-type or laminar materials. The film pockets consist of at least one support film and at least one cover film. At least the larger of these films in terms of surface area has two parallel side edges. The film-type or laminar material is enclosed in a gas-tight and moisture-tight manner between the support film and the cover film. The support film, at least one edge lying transversely or obliquely with respect to the side edge, protrudes beyond the nearest edge of the cover film. The device comprises a housing which is partitioned at least once and on whose lateral inner faces the side edges of the stacked film pockets bear, while the edge of the support film protruding beyond the edge of the associated cover film bears on a front inner face. The stacked film pockets are pressed with spring-loading against the upper inner face of the housing.

A container of this kind is known from U.S. Pat. No. 5,337,897 A. The film pockets are pushed out of the container by means of a finger pad. For this purpose, the housing has a suitably large, uncloseable opening. The user also has to separately open the removed film pocket in order to be able to use the film-type or laminar material integrated in the film pocket.

Moreover, an automatic sheet dispenser, for example for visiting cards, is known from WO 99/28211 A2. The sheet dispenser consists of a container provided with a lid. The container is filled with a stack of individual sheets of paper. The stack bears, via a support, on a compression spring which presses it against a transport roller integrated in the lid. Between the lid and the container, in the area of the transport roller, there is an ejection slit through which sheets or visiting cards are ejected individually by means of a manually induced rotation of the transport roller.

Furthermore, US-DES 371,723 discloses a container which is used for storing and providing stacked film-type or laminar materials, for example edible films. The film stack is introduced into the container via a large partition separating the container at about the middle. The provision of the individual films is effected via a separate closable flap. The films are stacked directly on one another and are separated from the environment only by the container with the two partitions providing only limited sealing. If the edible films tend to lose their aroma or to dry out, they have to be consumed within a short time in order to avoid their becoming inedible.

Therefore, the problem on which the present invention is based is that of making available a device for storing and providing stacked film-type or laminar materials, which device stores the stacked materials from the first to the last withdrawal without any appreciable change in their aromatic properties.

This problem is solved by the features of the main claim. The front, upper area of the housing has two slits for separate ejection of the individual film pocket parts, the film-type or laminar material being ejected with one of the two film pocket parts. A separating tool for separating support film and cover film is arranged between the slits, on which tool the uppermost support film bears spatially in front of the front edge of the cover film. Above the front half of the uppermost film pocket, and bearing thereon, a transport element which is rotatable about an axis of rotation and is at least approximately transverse with respect to the side edges of the support film is arranged in a housing opening.

With this invention, the film-type or laminar materials are packaged at least twice. The materials are, for example, lamellae whose surface area corresponds approximately to that of an average thumbprint. The lamellae contain a pharmaceutical active substance, for example. The lamellae are used, for example, by placing them on the tongue. The lamellae dissolve within a few seconds under the action of saliva. The active substance is released in the process.

To ensure that the often volatile active substances and/or aromatic substances contained in the lamellae are maintained until the time of consumption, they are sealed individually in thin film pockets acting as primary packaging. The generally sensitive film pockets are accommodated in stacked form in a so-called secondary packaging in a gauged manner. The secondary packaging is in this case a lamella dispenser. For this purpose, it is equipped with a mechanism by which the individual film pocket is directly released without direct finger contact. In this process, the film pocket is automatically opened and the individual lamella is presented ready for consumption.

Further details of the invention are set out in the dependent claims and in the following description of a diagrammatically depicted illustrative embodiment.

BRIEF DESCRIPTION OF THE DRAWINGS

FIGS. 1 and 2 show a film pocket (10) with an inserted film-type or laminar material (1). The latter, also called filling or lamella, is a film, for example, which can contain a pharmaceutical active substance. The film pocket is also referred to as primary packaging.

Figure 1:
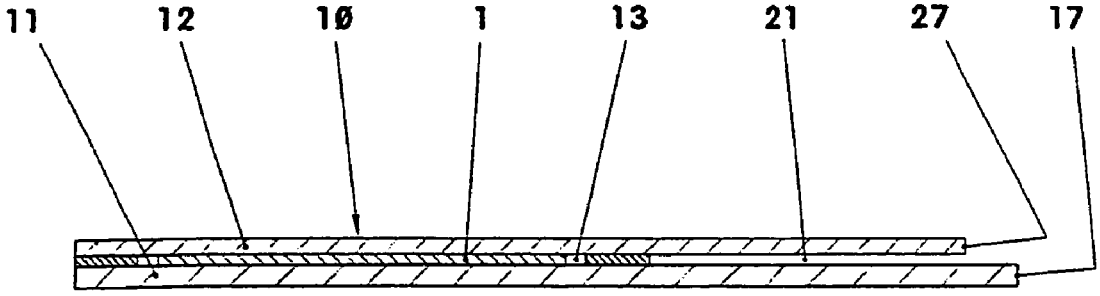
FIG. 1: film pocket in longitudinal section.

The film pocket consists, for example, of two films between which the lamella (1) is inserted over its full surface area. The two films (11, 12) are adhesively bonded, sealed, or the like, round the lamella (1), at a short spacing from the lamella edges. The lamella (1) consequently lies in a gas-tight and moisture-tight hollow space. It adheres, for example, to the cover film (12) more strongly than it does to the support film (11). For reasons of simplicity, the films (11, 12) in the illustrative embodiment are connected to one another, for example by means of an applied adhesive (13).

Figure 2:
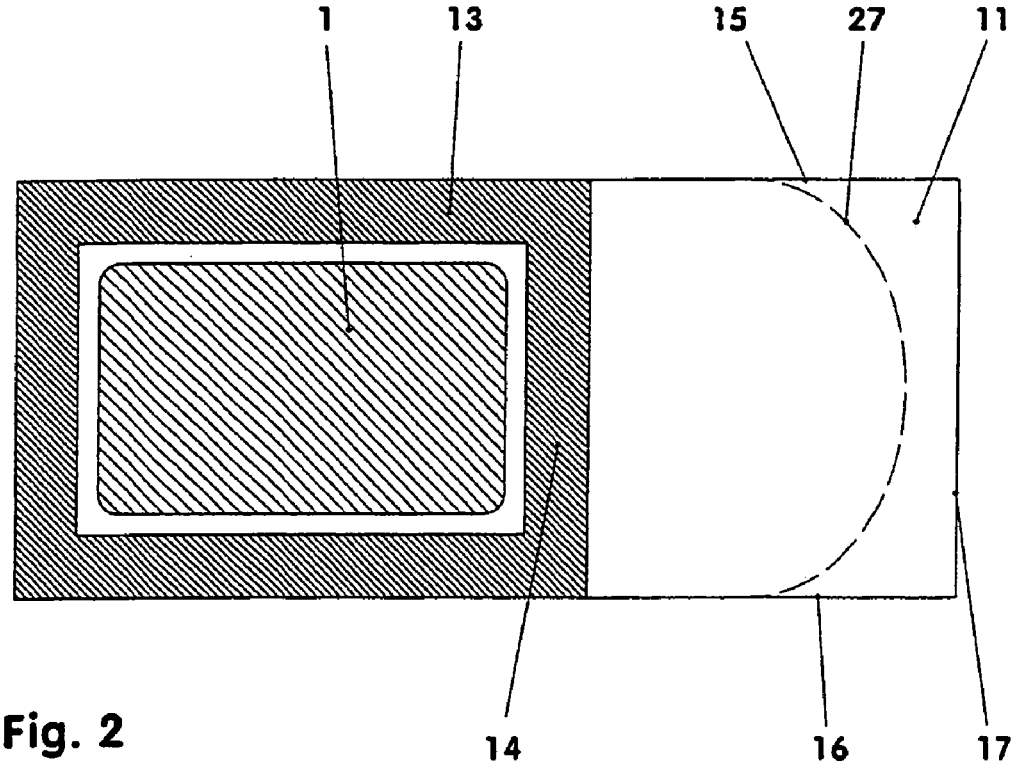
FIG. 2: plan view of FIG. 2 without cover film.

The support film (11) is a rectangular film whose length corresponds, for example, to twice its width. The lamella (1) is placed on the support film (11), see FIGS. 1 and 2. Around the lamella (1), the support film (11) is coated with adhesive (13), for example in a strip pattern. The adhesive (13) does not come into contact with the lamella (1). The cover film (12), shown by a broken line in FIG. 2, is placed firmly on the lamella (1) and the adhesive (13).

The cover film (12) here has the same width as the support film (11). However, it is shorter. Its for example semi-elliptical front edge (27) is offset rearward, e.g. by a few millimeters. Between the front edge (27) and the front portion (14) of the adhesive (13) there is a gap (21), see FIG. 1, extending about one third of the length. The films (11, 12) do not adhere to one another in this area.

As an alternative to the film pocket (10) shown in FIGS. 1-4, the primary packaging can also consist of films which have a depression in the contact area with the filling (1). A depression in just one film is also conceivable. In both cases, the edge areas of the films then lie with their full surface area on one another, despite the inserted filling (1), so that the height of the gap (21) becomes almost infinitely small.

Figure 3:
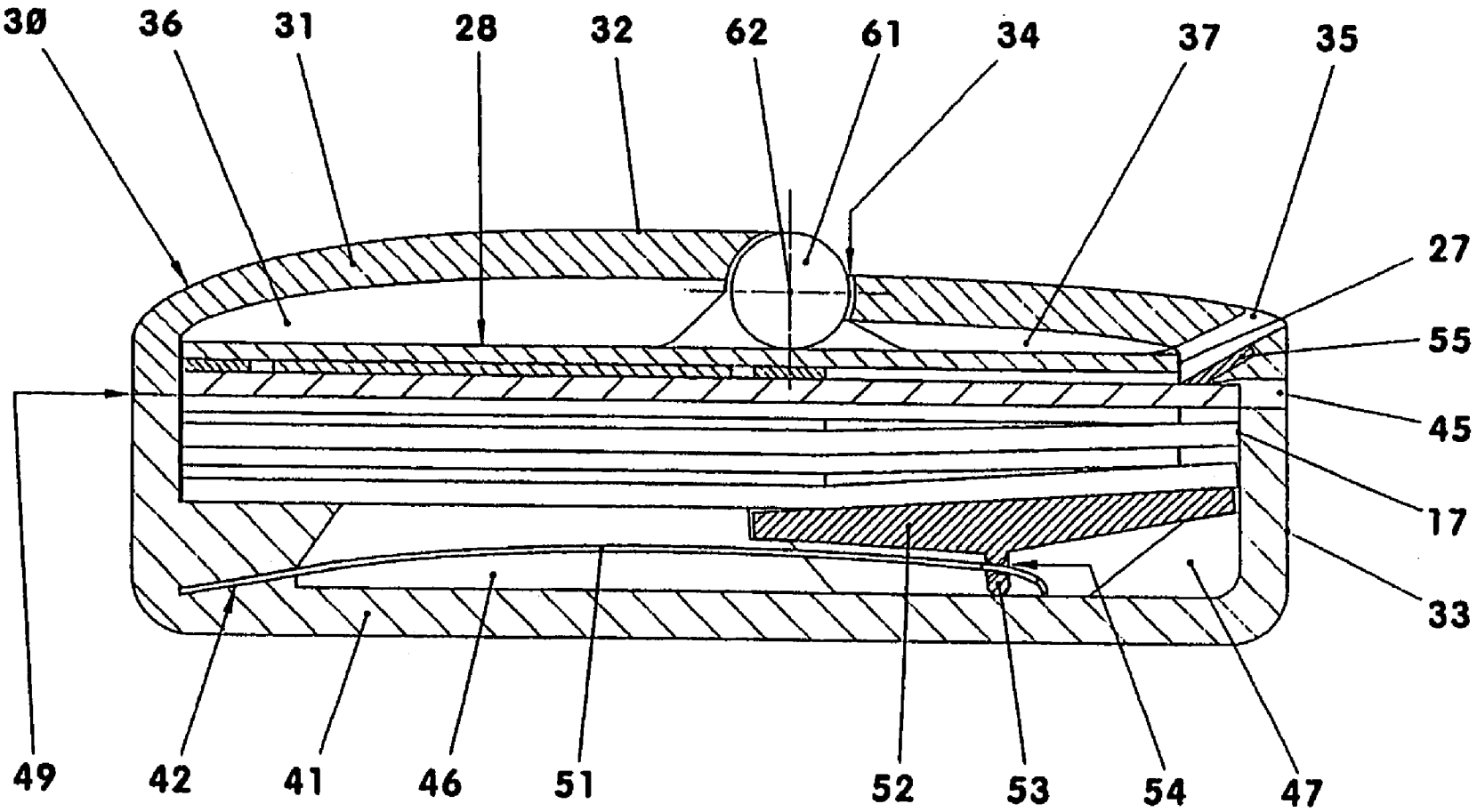
FIG. 3: secondary packaging in longitudinal section.
Figure 4:
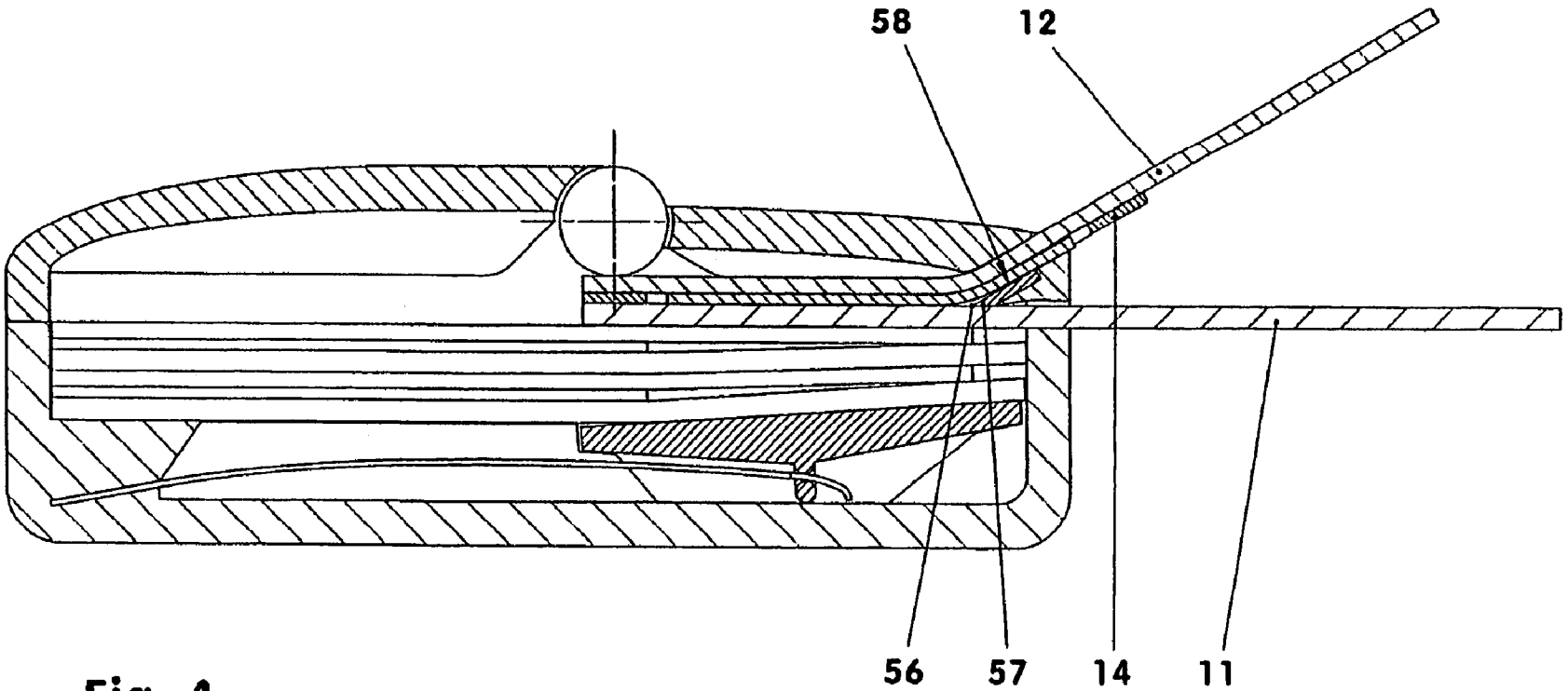
FIG. 4: secondary packaging from FIG. 3 with filling made ready.
Figure 5:
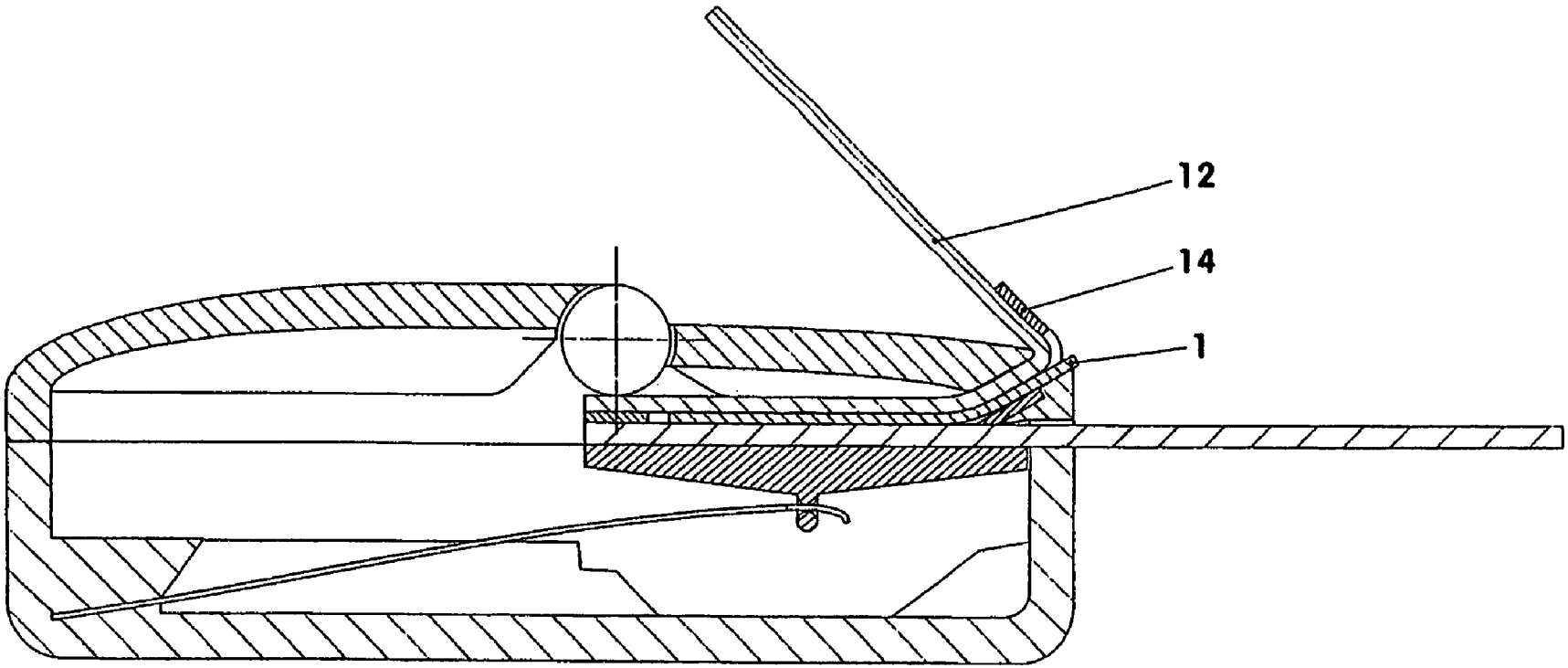
FIG. 5: secondary packaging from FIG. 3 with last filling made ready.

FIGS. 3-5 show a so-called secondary packaging (30) which on the one hand stores the film pockets (10) and on the other hand delivers them when required. In the process of delivering them, the film pocket (10) is opened in order to release the filling (1). This is done with the aid of a separating tool (55) arranged in the secondary packaging (30), and a transport roller (61). The transport roller (61) pushes the film pocket (10) over the separating tool (55) which splits open the join between the cover film (12) and the support film (11).

To be able to illustrate this opening or splitting operation clearly, the film pocket (10) in FIGS. 1-5 is shown in a simplified and diagrammatic manner. The thicknesses of the films (11, 12) and of the adhesive (13) are shown very much enlarged in relation to the other geometric film dimensions.

FIG. 3 shows a secondary packaging (30) in the form of a two-part housing (31, 41) in which a stack (28) of film pockets (10) is inserted. The film pockets (10) lie oriented in the same direction on top of one another in the stack (28), with the cover film (12) facing upward. Only the uppermost film pocket (10) is shown in cross section in FIGS. 3-5.

The housing of the secondary packaging (30) here comprises, for example, a trough-shaped bottom part (41), and a top part (31) like a lid. Between both parts (31, 41) there is, for example, a horizontal partition line (49). A leaf spring (51) and a rocker-type pressure plate (52) are arranged in the bottom part (41). The leaf spring (51), oriented over a wide area at least approximately parallel to the stack (28), is shown in FIGS. 3-5 with its left end rigidly fixed in the bottom part (41). The pressure plate (52) is articulated with play at the free end of the leaf spring (51). For this purpose, the pressure plate (52) has an arm (53) which is, for example, oriented substantially perpendicular to the leaf spring (51) and which has a slit (54) for receiving the leaf spring (51). The leaf spring (51), which springs upward when not loaded by the stack (28), is wider in the area between the rigid fixing point (42) in the bottom part (41) and the slit (54) than it is in the area guided through the slit (54). This ensures that, when the secondary packaging (30) is almost empty, the pressure plate (52) does not accidentally migrate toward the fixing point (42).

The free end of the leaf spring (51) protruding from the slit (54) is bent downward so that, in the event of the secondary packaging (30) being refilled, the leaf spring (51) does not come unhinged. Instead of the bend, the leaf spring (51) can be provided with a ring or a rolled-up end, a split, or some comparable arrangement. If appropriate, the leaf spring (51) can be designed as a component with a large surface area, so that it can also take over the function of the then omitted pressure plate (52).

In the lower area of the bottom part (41), on both sides alongside the leaf spring (51), bridges (46, 47) or shoulders e.g. are unformed, which, at least when the secondary packaging (30) is completely filled, serve as a support for the stack (28) and the pressure plate (52), cf. also FIG. 5.

The top part (31) in FIGS. 3-5 is shown, only by way of example, sitting on the bottom part (41) via a plane partition line (49). Both parts are, for example, interlocked, adhesively bonded or screwed etc. to one another in a releasable or non-releasable manner, depending on whether re-filling of the secondary packaging (30) is intended or not.

In the top part (31), the transport roller (61) is arranged in a housing opening (34) roughly at the center. The transport roller (61) is oriented transversely with respect to the longitudinal extent of the film pockets (10) and at least approximately parallel to the surface of the uppermost film pocket (10). In the illustrative embodiment, the transport roller (61) sits in the area of a housing shoulder. The higher-lying shoulder area (32) extends at least approximately tangentially to the transport roller (61), while the lower-lying shoulder area ends approximately at the height of the center of the roller. By means of this configuration, about a quarter of the circumference of the transport roller protrudes from the contour of the top part (31). The gap between the transport roller (61) and the housing opening (34) is so narrow that large particles of dirt cannot get into the inside of the housing. If appropriate, this gap between the transport roller (61) and the housing opening (34) is closed off by a suitable seal.

The transport roller (61) has a diameter which is at least twice as great as the wall thickness in the area of the housing opening (34). For example, it is several millimeters. The stack (28) is pressed against the transport roller (61) from underneath by means of the spring action of the bending spring (51). The material used for the transport roller (61) is a plastic or a rubber mixture which, with the material of the cover film surface, forms a friction pairing which ensures a high coefficient of static friction.

The transport roller (61) is shown here as a smooth cylindrical body. The cylinder surface can also be knurled or otherwise profiled. For example, the profile can have a nipple structure. Of course, the cylinder shape may also only be an imaginary envelope surface defined by a plurality of separate small wheels arranged next to one another on an axle.

In the top part (31), bridges (36, 37) or housing shoulders are arranged in front of and behind the transport roller (61). The respective upper film pocket (10) bears against these. The surfaces with which the bridges (36, 37) make contact with the film pocket. (10) extend, at least in parts, tangentially to the surface of the transport roller (61). The bridges (36, 37) ensure a planar, tangential bearing of the uppermost film pocket (10) on the transport roller (61).

The housing (31, 41) has two slits (35) and (45) in the area of its front wall (33). Both slits (35, 45) are here oriented transversely with respect to the longitudinal extent of the film pockets (10). They are integrated only by way of example in the top part (31).

The lower slit (45) serves for ejection of the support film (11). It is positioned in the top part (31) directly in front of the front edge (17) of the support film (11). Its width and height are each slightly greater than the respective width and thickness dimensions of the support film (11).

Above the lower slit (45), a straight blade (55), for example, is arranged as a separating tool in the top part (31). The blade (55) is secured in the top part (31) by, for example, being partially encapsulated or being bonded into place. It protrudes into the inside of the housing at, for example, a 30° angle with respect to the horizontal or to the plane surface of the support film (11). The depth of its insertion is chosen so that the cutting edge (56) of the blade (55), cf. FIG. 4, ends directly in front of the frontmost point of the front edge (27) of the cover film (12). The for example beveled cutting flank (57) of the blade (55) serves as a front, upper bearing for the uppermost support film (11).

Above the blade (55), the upper slit (35) extends, for example, parallel to said blade (55). The cover film (12) is guided out of the secondary packaging (30) through this slit (35). The slit height chosen is so great that the cover film (12) and the filling (1) adhering to it pass through it without any problem.

Both slits (35, 45) can be closed off with, for example, in each case at least one sealing lip. A sealing lip, if used, can be arranged, for example, at an acute angle with respect to the film (11, 12) to be pushed out. At an angle below 45°, the film (11, 12) can push the sealing lip aside without any problem in order to open it.

To release the filling (1) of the uppermost film pocket (10), the user actuates the transport roller (61) in the counterclockwise direction. The transport roller (61) pushes the film pocket (10) toward the slits (35, 45), cf. also FIG. 4. The front edge (27) of the cover film (12) slides along the back (58) of the blade and through the slit (35) to the outside. In this first movement, the force that has to be applied is very low because, in the front area of the film pocket (10), that is to say the gap (21) according to FIG. 1, the films (11, 12) lie on one another without adhering. Only when the front portion (14) of the adhesive (13) reaches the cutting edge (57) does the separating work have to be performed. By then, however, the films (11, 12) already protrude many millimeters from the secondary packaging (30), cf. FIGS. 4 and 5, so that the force needed for separating the films (11, 12) can also be applied by pulling out one of the two films (11, 12). It is pulled out using the fingers. The respective other film (11) or (12) is pushed out from its corresponding slit (35) or (45) until both films (11, 12) are completely separated. This final separation takes place only at the rear edge of the film pocket (10), since the adhesive (13) connecting the two films (11, 12) reaches as far as that point.

If so required, in order to permit easier detachment of the filling (1) or lamella (1) from the cover film (12), the latter, as it is being pulled out, can be drawn rearward in the direction of the transport roller (61), cf. FIG. 5. The inherent stiffness of the lamella (1) suffices to permit lifting from the cover film. To ensure that the cover film (12) does not start to tear in this process, the transition between the upper slit (35) and the upwardly facing housing part of the top part (31) is rounded.

To avoid incorrect use by turning the transport roller (61) in the clockwise direction, a rotation block can be provided between the transport roller (61) and the housing (31) by means of a direction-blocking mechanism.

To reduce the separating force for separating the two films (11, 12), the separating tool (55) can also be arranged obliquely with respect to the longitudinal extent of the film pocket (10). If appropriate, a curved blade, for example a backswept blade, can also be used.

The separating action of the separating tool (55) does not have to be based on a cutting process. The connection between the films (11, 12) can also be broken by simply forcing them apart by means of a blunt separating tool (55). For this purpose, the corresponding separating tool only has to be able to lift the film (12) from the film (11) at the start of the separating process.

Depending on the shape of the housing (31, 41), the slits (35, 45) can also have a curved or backswept configuration. If appropriate, for example, a slit (35, 45) can also be oriented obliquely with respect to the longitudinal extent of the film pockets (10).

Of course, the lamella (1) inside the film pocket (10) can, if appropriate, also adhere more strongly to the support film (11) than to the cover film (12). The lamella (1) can then be removed from the lower slit (45). For this case, the slits (35, 45) may have to be given new dimensions.

During delivery of the films (11, 12) from the slits (35, 45), the stack (28) in the secondary packaging (30) migrates upward under the action of the bending spring or leaf spring (51). The now uppermost film pocket (10) bears on the transport roller (61). A new removal procedure can be started.

LIST OF REFERENCE NUMBERS

1 film-type or laminar material, filling, lamella
10 film pocket, primary packaging
11 support film
12 cover film
13 adhesive
14 front portion of (13)
15, 16 side edges of (11)
17 front edge of (11)
21 gap
27 front edge of (12)
28 stack of (10)
30 secondary packaging
31 housing top part, housing
32 shoulder area, in higher position
33 front wall
34 housing opening for (61) slit for (12) and (1)
36, 37 bridges
41 housing bottom part, housing
42 fixing point
45 slit for (11)
46, 47 bridges
49 partition line
51 leaf spring
52 pressure plate
53 arm on (52)
54 slit for (51)
55 separating tool, blade
56 cutting edge
57 cutting flank
58 back of blade
61 transport element, transport roller
62 axis of rotation

The invention claimed is:

1. A device which stores and provides stacked film pockets filled with film-type or laminar materials, wherein, the stacked film pockets consist of at least one support film and at least one cover film, in which the at least one support film or at least one cover film which has a greater surface area has two parallel side edges, wherein, the film-type or laminar material is enclosed in a gas-tight and moisture-tight enclosure between the support film and the cover film, in which the support film has at least one edge lying transversely or obliquely with respect to a front edge of the support film and protrudes beyond a front edge of the cover film, wherein, the device comprises a housing which:

(i) is partitioned at least once and the side edges of the stacked film pockets face a lateral interior of the housing, while an edge of the support film protrudes beyond an edge of the cover film and faces a front interior of the housing, (ii) has the stacked film pockets pressed by spring-loading against an upper interior of the housing, wherein a front, upper area of the housing has two slits for separate ejection of an individual film pocket, the film-type or laminar material being ejected with one of the individual film pocket of the stacked film pockets;

a separating tool for separating support film and cover film is arranged between the slits and, wherein the separating tool contacts at least the support film of the uppermost individual film pocket prior to separation and above a front half of an uppermost film pocket of the stacked film pockets, a transport element which contacts the film pockets and which is rotatable about an axis of rotation and is at least transverse with respect to one of the two parallel side edges of the at least one support film or at least one cover film which has the greater surface area and is arranged in a housing opening.

2. The device as claimed in claim 1, wherein, between the a lateral interior of the front edge of the support film and a nearest adhesion point or sealing point of the cover film, there is no adherence between the support film and the cover film.

3. The device as claimed in claim 1, wherein the support film is adhesively bonded to the cover film.

4. The device as claimed in claim 1, wherein a front edge of the cover film has a semi-elliptical contour.

5. The device as claimed in claim 1, wherein the transport element is a cylindrical transport roller.

6. The device as claimed in claim 5, wherein the transport roller has at least a rubber-like coating.

7. The device as claimed in claim 1, wherein the device contains an upper slit, through which the cover film is ejected, and a lower slit wherein the upper slit is arranged between the transport roller and the lower slit.

8. The device as claimed in claim 1, wherein the film-type or laminar material is a drug form containing a pharmaceutical active substance.

9. The device as claimed in claim 1, wherein at least the film of greater surface area has two parallel side edges in some sections.

10. The device as claimed in claim 1, wherein the separating tool for separating support film and cover film is a blade which is at an angle of about 30° to the surface of the uppermost film pocket and is flat on the surface of the uppermost support film.

11. The device as claimed in claim 1, wherein the housing has a trough-shaped bottom part and a top lid part, wherein the bottom part contains the stacked film pockets, and the top lid part contains an upper slit, a lower slit and a transport roller.

12. The device as claimed in claim 1, wherein the film-type or laminar material adheres more strongly to the cover film than it does to the support film.

13. The device as claimed in claim 2, wherein the support film is adhesively bonded to the cover film.

14. The device as claimed in claim 13, wherein the front edge of the cover film has a semi-elliptical contour.

15. The device as claimed in claim 14, wherein the transport element is a cylindrical transport roller.

16. The device as claimed in claim 15, wherein the device contains an upper slit, through which the cover film is ejected, and a lower slit wherein the upper slit is arranged between the transport roller and the lower slit.

17. The device as claimed in claim 16, wherein the individual film-type or laminar material is a drug form containing a pharmaceutical active substance.

18. The device as claimed in claim 17, wherein the separating tool for separating support film and cover film is a blade which is at an angle of about 30° to the surface of the uppermost film pocket and is flat on the surface of the uppermost support film.

19. The device as claimed in claim 18, wherein the housing has a trough-shaped bottom part and a top lid part, wherein the bottom part contains the stacked film pockets, and the top lid part contains an upper slit, a lower slit and a transport roller.

20. The device as claimed in claim 19, wherein the film-type or laminar material adheres more strongly to the cover film than it does to the support film.

* * * * *